US008100636B2

(12) United States Patent
Schmitt

(10) Patent No.: US 8,100,636 B2
(45) Date of Patent: Jan. 24, 2012

(54) RECOVERY OF EXPANDER-BOOSTER LEAK GAS

(75) Inventor: Nathalie P. Schmitt, Houston, TX (US)

(73) Assignee: Air Liquide Process & Construction, Inc., Houston, TX (US)

( * ) Notice: Subject to any disclaimer, the term of this patent is extended or adjusted under 35 U.S.C. 154(b) by 597 days.

(21) Appl. No.: 12/344,663

(22) Filed: Dec. 29, 2008

(65) Prior Publication Data

US 2009/0246004 A1 Oct. 1, 2009

Related U.S. Application Data

(60) Provisional application No. 61/039,450, filed on Mar. 26, 2008.

(51) Int. Cl.

| | |
|---|---|
| ***F01D 31/00*** | (2006.01) |
| ***F01D 27/02*** | (2006.01) |
| ***F01D 25/16*** | (2006.01) |
| ***F01D 11/00*** | (2006.01) |
| ***F01D 25/00*** | (2006.01) |

(52) U.S. Cl. ..... 415/116; 415/1; 415/176; 415/230

(58) Field of Classification Search ..... 415/116, 415/168.1, 1, 171.1, 174.5, 176, 230
See application file for complete search history.

(56) References Cited

U.S. PATENT DOCUMENTS

| | | | | |
|---|---|---|---|---|
| 3,420,434 A | | 1/1969 | Swearingen | |
| 4,099,727 A | | 7/1978 | Weiler | |
| 4,477,223 A | * | 10/1984 | Giroux | 415/168.2 |
| 6,345,954 B1 | * | 2/2002 | Al-Himyary et al. | 415/112 |
| 7,074,016 B1 | * | 7/2006 | Epstein et al. | 417/348 |
| 2008/0031750 A1 | | 2/2008 | Gomilar et al. | |

FOREIGN PATENT DOCUMENTS

| | | |
|---|---|---|
| GB | 618133 | 2/1949 |

OTHER PUBLICATIONS

PCT Search Report and Written Opinion for PCT/IB2009/051152.

* cited by examiner

*Primary Examiner* — Chuong A. Luu
(74) *Attorney, Agent, or Firm* — Elwood L. Haynes

(57) ABSTRACT

A seal gas recovery method including introducing a first seal gas stream to a first mechanically coupled booster/expander assembly, where the first booster/expander assembly includes a first booster, a first expander, a first shaft that mechanically couples the first booster and the first expander, and a first seal on the first shaft. The method further includes removing at least a portion of a first recoverable gas stream from the first seal, where the first recoverable gas stream includes at least a portion of a first process leak gas stream and at least a portion of a first seal gas vent stream. The method further includes introducing a second seal gas stream to a second expander assembly, where the expander assembly includes a second expander, a second shaft, and a second seal on the second shaft. The method further includes removing at least a portion of a second recoverable gas stream from the second seal, where the second recoverable gas stream includes at least a portion of a second process leak gas stream. The method further includes combining at least a portion of the first recoverable gas stream and at least a portion of the second recoverable gas stream to form a third recoverable gas stream. The method further includes introducing at least a portion of the third recoverable gas stream into the second expander.

11 Claims, 1 Drawing Sheet

Labyrinth

RECOVERY OF EXPANDER-BOOSTER LEAK GAS

CROSS REFERENCE TO RELATED APPLICATIONS

This application claims the benefit of U.S. Provisional Application No. 61/039,450, filed Mar. 26, 2008, the entire contents of which are incorporated herein by reference.

BACKGROUND

The use of dry gas seals in process gas centrifugal compressors has experienced a dramatic increase over the past couple of decades. Most centrifugal gas compressors manufactured and sold today have dry gas seals.

As the shaft must have clearance within the bearings to allow low-friction operation, some type of shaft sealing must be utilized in order to prevent higher pressure process gas from escaping the compressor housing freely. This escape may represent a contamination of the work environment or the global environment, or simply represent an inefficiency and loss of valuable compressed process gas.

Typical multi-stage compressors require at least two seals, one at opposing ends of the shaft. Dry gas seals are face seals that consist of a rotating ring and a stationary ring. During normal operation, fluid dynamic forces cause a gap between these rings. Some type of sealing gas is then injected into this gap and provide a seal between the external atmosphere (or sometimes a flare system) and the compressor internal process gas. Often there is an internal labyrinth arrangement that separates the process gas from the seal gas.

An expander-booster machine may use gas bearings to prevent oil ingress into the process stream and an temperature migration between the expander and the booster. Process air may also leak from the higher pressure of the booster side to lower pressure of the seal gas side. A significant portion of these leak and seal gases can ordinarily be recovered at medium pressure and re-injected at BAC suction.

The above comments regarding dry gas seals, and their common applications, are not intended to limit the scope of the claimed invention. The comments are made by way of explanation only. For example, the hereinafter described and illustrated preferred embodiments of dry gas seals could be used in other applications and/or in conjunction with gases other than those mentioned above.

In a process scheme at high pressure with a single machine, the main air source pressure is too high to allow the expander-booster air losses to be recovered. These losses are thus vented to atmosphere. As a result the corresponding air flow-rate is compressed by the MAC and not used further in the process. The corresponding power loss can reach 1% of the total compression power of the plant, depending of the size of the expander booster. There is a need in the industry for a method that can allow these power losses to be significantly reduced.

SUMMARY

The present invention is a seal gas recovery method comprising introducing a first seal gas stream to a mechanically coupled booster/expander assembly, wherein said booster/expander assembly comprises a booster, an expander, a shaft that mechanically couples said booster and said expander, and a seal on said shaft. The method further comprises removing at least a portion of a first recoverable gas stream from said seal, wherein said first recoverable gas stream consists of at least a portion of at process leak gas stream. The method further comprises introducing at least a portion of said first recoverable gas stream into said second expander. In one embodiment, the first expander is the same as the second expander.

In another embodiment, the first recoverable gas stream consists of at least a portion of a process leak gas stream and at least a portion of a seal gas vent stream.

In another embodiment, the method may further comprise introducing a second seal gas stream to a second expander assembly, wherein said second expander assembly comprises a second expander, a second shaft, and a second seal on said second shaft. The method further comprises removing at least a portion of a second recoverable gas stream from said second seal, wherein said second recoverable gas stream consists of at least a portion of a second process leak gas stream. The method further comprises combining at least a portion of said first recoverable gas stream and at least a portion of said second recoverable gas stream to form a third recoverable gas stream. The method further comprises introducing at least a portion of said third recoverable gas stream into said second expander.

In another embodiment, the method may comprise a second booster/expander assembly, wherein said second booster/expander assembly comprises a second booster, a second expander, a second shaft that mechanically couples said second booster and said second expander, and a second seal on said second shaft. In another embodiment, the method may be sued in an air separation plant. In another embodiment, at least a portion of said expanded third recoverable gas stream is vented to atmosphere.

In another embodiment, said second expander is mechanically coupled to a brake. In another embodiment, said brake may be a generator or an oil brake. In another embodiment, said first booster and said second booster increase the pressure of different fluids. In another embodiment, said first expander and said second expander decreases the pressure of different fluids.

BRIEF DESCRIPTION OF DRAWINGS

The invention may be understood by reference to the following description taken in conjunction with the accompanying drawings, and in which.

DESCRIPTION OF PREFERRED EMBODIMENTS

Figure 1:
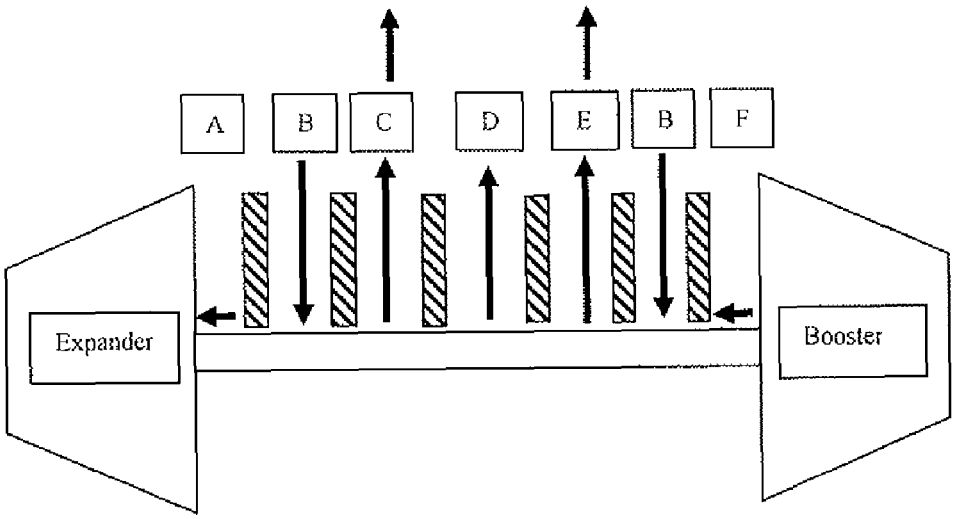
FIG. 1 is a schematic representation of a typical shaft seal of one embodiment of the present invention.

Referring now to FIG. 1, the labyrinth which separates and directs the various gases is illustrated. Warm seal gas enters the system at B. A portion of the higher pressure process gas leaks past the seals and into the labyrinth at F. A portion the seal gas or other leakage gas within the labyrinth, which is at a pressure relatively higher than that within the expander, leaks past the seals and into the expander at A. Inevitably, a portion of the seal gas and leakage gas is irrecoverably lost to the atmosphere at D. A portion of the sealing gas and the process gas that has leaked into the labyrinth from the booster will be recoverable at E. At the expander end of the shaft, predominantly seal gas will be recoverable at C. It is the recovery and recycling of these recoverable streams (C and D) that are the object of the present invention, whereby the corresponding flow and power are therefore saved.

Figure 2:
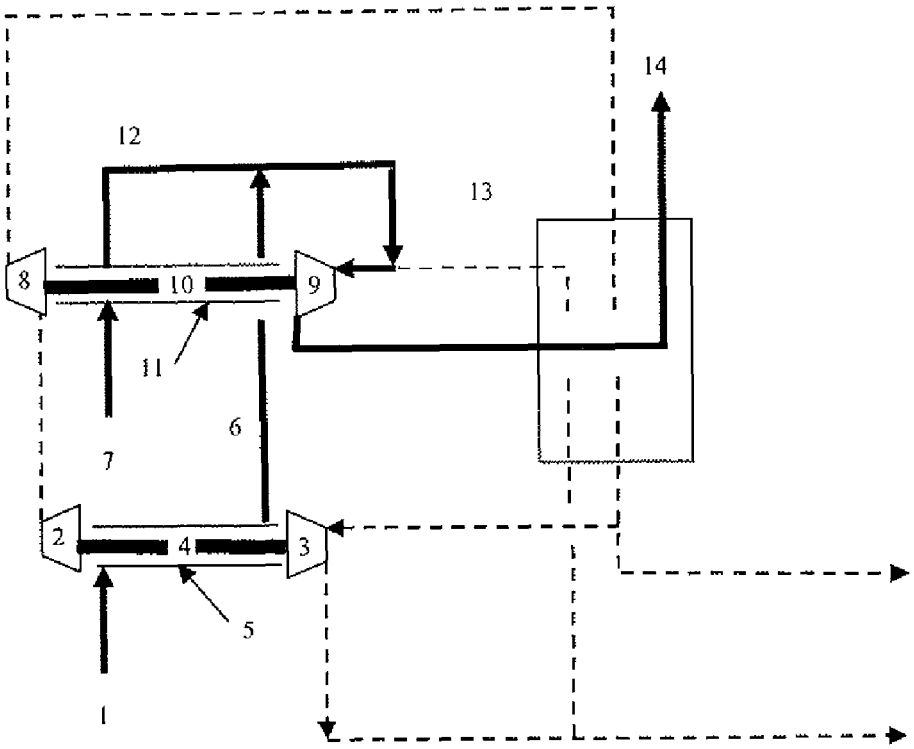
FIG. 2 is a schematic representation of one embodiment of the present invention.

Referring now to FIG. 2, a first seal gas stream 1 is introduced to a first mechanically coupled booster/expander assembly. This first booster/expander assembly comprises a first booster 2, a first expander 3, a first shaft 4 that mechanically couples this first booster 2 and this first expander 3, and a first seal 5.

As discussed above with reference to FIG. 1, at least a portion of a first recoverable gas stream 6 is removed from this first seal. This first recoverable gas stream 6 consisting of at least a portion of a first process leak gas stream $E_1$ stream and at least a portion of a first seal gas vent stream $C_1$. Note that first process leak gas $E_1$ may comprise leaking seal gas as well as leaking process gas. In one embodiment, at least a portion of this first recoverable gas stream 6 may be introduced into an expander (3 or 9).

In one embodiment, a second seal gas stream 7 is introduced to a second expander assembly. This second expander assembly comprises a second expander 9, a second shaft 10 and a second seal 11. In another embodiment, a second seal gas stream 7 is introduced to a second mechanically coupled booster/expander assembly. This second booster/expander assembly comprises a second booster 8, a second expander 9, a second shaft 10 that mechanically couples this second booster 8 and this second expander 9, and a second seal 11. In another embodiment, the second expander 9 may be mechanically coupled to a brake, wherein said brake may include, but not be limited to, a generator or an oil brake.

For simplicity, FIG. 2 indicates the same fluid passing through first booster 2, first expander 3, second booster 8, and second expander 9. These pressure manipulating devices do not necessarily handle the same fluid. In one embodiment, the first expander may process air and the second expander may handle nitrogen.

As discussed above with reference to FIG. 1, at least a portion of a second recoverable gas stream 12 is removed from this second seal. This second recoverable gas stream 12 consisting of at least a portion of a second process leak gas stream $E_2$.

At least a portion of the first recoverable gas stream 6 and at least a portion of the second recoverable gas stream 12 are combined to form a third recoverable gas stream 13. In one embodiment, at least a portion of the third recoverable gas stream 13 is then introduced into the suction of second expander 9. The suction pressure of second expander 9 must be lower than that of any other point within the system. The skilled artisan would recognize that third recoverable gas stream 13 may be introduced into any expander within the system that operates at the appropriate pressure and with which the components of the stream are compatible.

The only remaining losses are the process leak gas, to atmosphere, which are never recoverable and the process leak gas from second expander 9, $C_2$, for which the pressure is too low.

Third recoverable gas stream 13 is not send to distillation, thus preventing of any risk of oil ingress in the process. Third recoverable gas stream 13 is vented to atmosphere after expansion in second expander 9, and optionally transferring heat in the main heat exchanger of an air separation unit. The above discussed seal gas recovery method may be used in an air separation plant.

Illustrative embodiments have been described above. While the method in the present application is susceptible to various modifications and alternative forms, specific embodiments thereof have been shown by way of example in the drawings, and have been herein described in detail. It should be understood, however, that the description herein of specific embodiments is not intended to limit the method in the present application to the particular forms disclosed, but on the contrary, the method in the present application is to cover all modifications, equivalents, and alternatives falling within the spirit and scope of the method in the present application, as defined by the appended claims.

It will, of course, be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but, would nevertheless, be a routine undertaking for those of ordinary skill in the art, having the benefit of this disclosure.

What is claimed is:

1. A seal gas recovery method comprising:

introducing a first seal gas stream to a mechanically coupled booster/expander assembly, wherein said booster/expander assembly comprises a booster, a first expander, a shaft that mechanically couples said booster and said first expander, and a first seal on said first shaft;

removing at least a portion of a first recoverable gas stream from said first seal, wherein said first recoverable gas stream consists of at least a portion of a process leak gas stream;

introducing at least a portion of said first recoverable gas stream into the suction of a second expander.

2. The seal recovery method of claim 1, wherein said first expander is the same as said second expander.

3. The seal gas recovery method of claim 1, wherein said wherein said first recoverable gas stream consists of at least a portion of a process leak gas stream and at least a portion of a seal gas vent stream.

4. A seal gas recovery method of claim 1, further comprising:

a introducing a second seal gas stream to a second expander assembly, wherein said second expander assembly comprises said second expander, a second shaft, and a second seal on said second shaft;

removing at least a portion of a second recoverable gas stream from said second seal, wherein said second recoverable gas stream consists of at least a portion of a second process leak gas stream, combining at least a portion of said first recoverable gas stream and at least a portion of said second recoverable gas stream to form a third recoverable gas stream;

introducing at least a portion of said third recoverable gas stream into the suction of said second expander.

5. The seal gas recovery method of claim 1, further comprising a second booster/expander assembly, wherein said second booster/expander assembly comprises a second booster, a second expander, a second shaft that mechanically couples said second booster and said second expander, and a second seal on said second shaft.

6. The seal gas recovery method of claim 1, wherein said method is used in an air separation plant.

7. The seal gas recovery method of claim 1, wherein at least a portion of said expanded third recoverable gas stream is vented to atmosphere.

8. The seal recovery method of claim 1, wherein said second expander is mechanically coupled to a brake.

9. The seal recovery method of claim 6, wherein said brake may be a generator or an oil brake.

10. The seal recovery method of claim 1, wherein said first booster and said second booster increase the pressure of different fluids.

11. The seal recovery method of claim 1, wherein said first expander and said second expander decrease the pressure of different fluids.

* * * * *

UNITED STATES PATENT AND TRADEMARK OFFICE

CERTIFICATE OF CORRECTION

PATENT NO. : 8,100,636 B2
APPLICATION NO. : 12/344663
DATED : January 24, 2012
INVENTOR(S) : Nathalie P. Schmitt It is certified that error appears in the above-identified patent and that said Letters Patent is hereby corrected as shown below:

In Column 4, line 33, replace the words “a introducing” with the word --introducing--.

In Column 4, line 40, replace the word “stream,” with the word --stream;--.

Signed and Sealed this
Thirteenth Day of March, 2012

David J. Kappos

David J. Kappos
*Director of the United States Patent and Trademark Office*